US006467378B1

(12) United States Patent
Chen

(10) Patent No.: US 6,467,378 B1
(45) Date of Patent: Oct. 22, 2002

(54) SINGLE-DIRECTIONAL RATCHET WRENCH STRUCTURE WITH A MATING BLOCK THAT MAY BE RETAINED IN POSITION BY A SNAP RING

(76) Inventor: Ching Chen, No. 1, Nong 2, Lane 741, Dong Ping Rd., Tai Ping City, Taichung Hsien (TW)

( * ) Notice: Subject to any disclaimer, the term of this patent is extended or adjusted under 35 U.S.C. 154(b) by 22 days.

(21) Appl. No.: 09/932,508

(22) Filed: Aug. 20, 2001

(51) Int. Cl.[7] ..... B25B 13/46
(52) U.S. Cl. ..... 81/60
(58) Field of Search ..... 81/60, 61, 62, 81/63, 63.1, 63.2

(56) References Cited

U.S. PATENT DOCUMENTS 5,636,557 A * 6/1997 Ma ..... 81/60
6,151,993 A * 11/2000 Shiao ..... 81/60
6,305,247 B1 * 10/2001 Chen ..... 81/60

* cited by examiner

*Primary Examiner*—Joseph J. Hall, III
*Assistant Examiner*—Joni B. Danganan

(57) ABSTRACT

A single-directional ratchet wrench structure includes a mating block which has an end portion opposite to the ratchet wheel and formed with an insertion groove, so that the C-shaped snap ring may be rested on the insertion groove of the mating block, such that the mating block may be retained in position by the C-shaped snap ring. Thus, the mating block will not be in contact with the ratchet teeth of the ratchet wheel during operation of the wrench.

3 Claims, 7 Drawing Sheets

SINGLE-DIRECTIONAL RATCHET WRENCH STRUCTURE WITH A MATING BLOCK THAT MAY BE RETAINED IN POSITION BY A SNAP RING

BACKGROUND OF THE INVENTION

1. Field of the Invention

The present invention primarily relates to a single-directional ratchet wrench structure, and more particularly to a single-directional ratchet wrench structure, wherein the mating block may be retained in position by the C-shaped snap ring, so that the mating block will not be in contact with the ratchet teeth of the ratchet wheel, thereby preventing the mating block from blocking operation of the ratchet wheel during operation of the wrench.

2. Description of the Related Art

A conventional single-directional ratchet wrench in accordance with the prior art shown in FIGS. 1 and 2 comprises a wrench 10 whose head is formed with a receiving recess 11 for receiving a ratchet wheel 12. One side of the receiving recess 11 is formed with a receiving space 111 for receiving a locking tooth block 13, a mating block 14, and a spring 15. The mating block 14 is mounted beside the locking tooth block 13 to limit the locking tooth block 13 during operation.

However, the mating block 14 may be freely moved in the receiving space 111 to a determined extent, so that one side of the mating block 14 may be in contact with the tooth faces of the ratchet wheel 12 during operation of the ratchet wheel 12, thereby causing inconvenience to operation of the ratchet wheel 12.

In addition, as shown in FIG. 2, the mating block 14 is closely rested on the tooth faces of the ratchet wheel 12 due to action of the spring 15, thereby causing inconvenience to operation of the ratchet wheel 12.

The present invention has arisen to mitigate and/or obviate the disadvantage of the conventional single-directional ratchet wrench structure The primary objective of the present invention is to provide a single-directional ratchet wrench structure, wherein the mating block may be retained in position by the C-shaped snap ring, so that the mating block will not be in contact with the ratchet teeth of the ratchet wheel, thereby preventing the mating block from interfering with operation and movement of the ratchet wheel during operation of the wrench.

In accordance with the present invention, there is provided a single-directional ratchet wrench structure, comprising:

a wrench, having a head formed with a receiving recess for receiving a ratchet wheel, a C-shaped snap ring snapped between the ratchet wheel and the receiving recess, one side of the receiving recess formed with a receiving space for receiving a mating block, a locking tooth block, and a spring, the locking tooth block engaging the ratchet wheel by the spring, the mating block mounted beside the locking tooth block;

wherein, the mating block has an end portion opposite to the ratchet wheel and formed with an insertion groove, so that the C-shaped snap ring may be rested on the insertion groove of the mating block, such that the mating block may be retained in position by the C-shaped snap ring.

Further benefits and advantages of the present invention will become apparent after a careful reading of the detailed description with appropriate reference to the accompanying drawings.

DETAILED DESCRIPTION OF THE INVENTION

Figure 1:
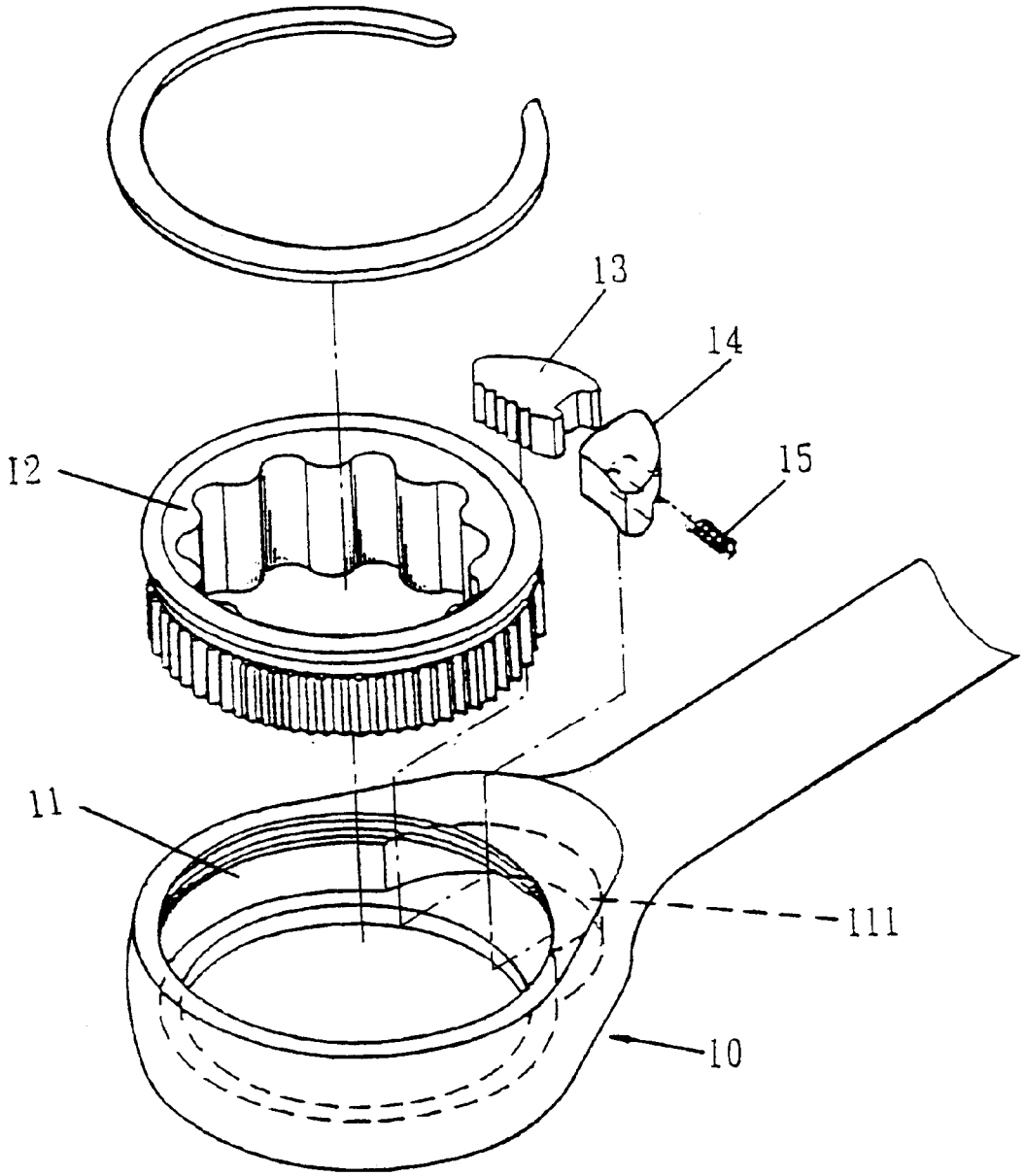
FIG. 1 PRIOR ART
FIG. 1 is an exploded perspective view of a conventional single-directional ratchet wrench structure in accordance with the prior art.
Figure 2:
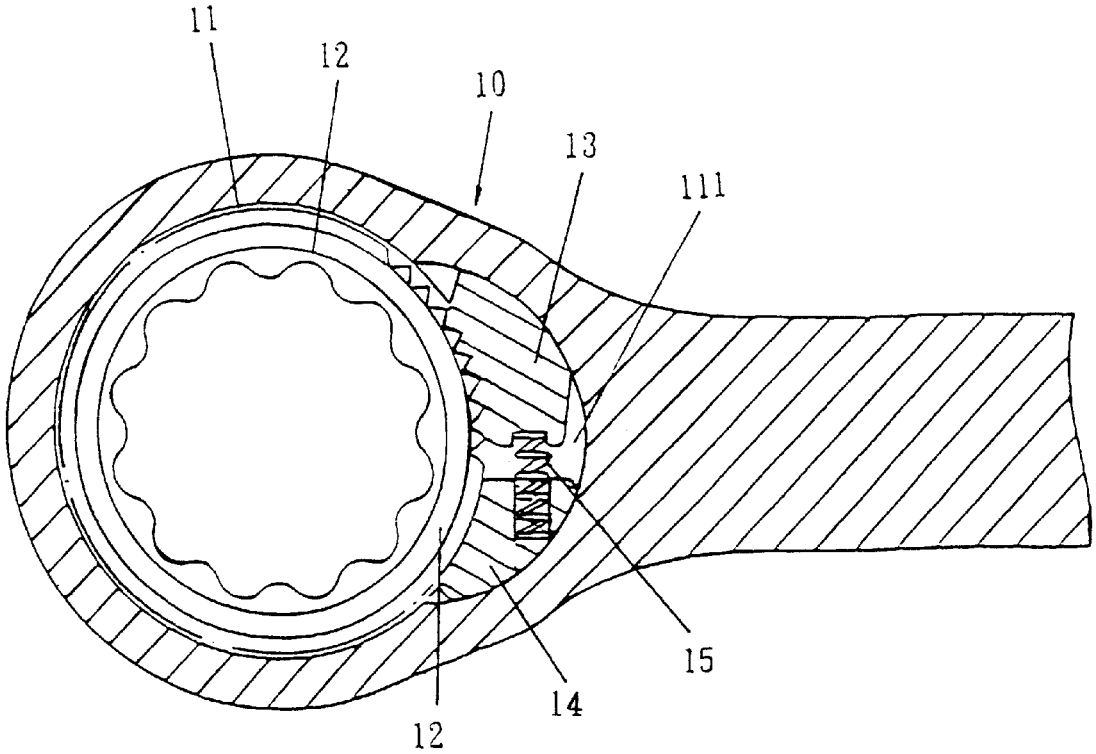
FIG. 2 PRIOR ART
FIG. 2 is a cross-sectional assembly view of the conventional single-directional ratchet wrench structure as shown in FIG. 1.
Figure 3:
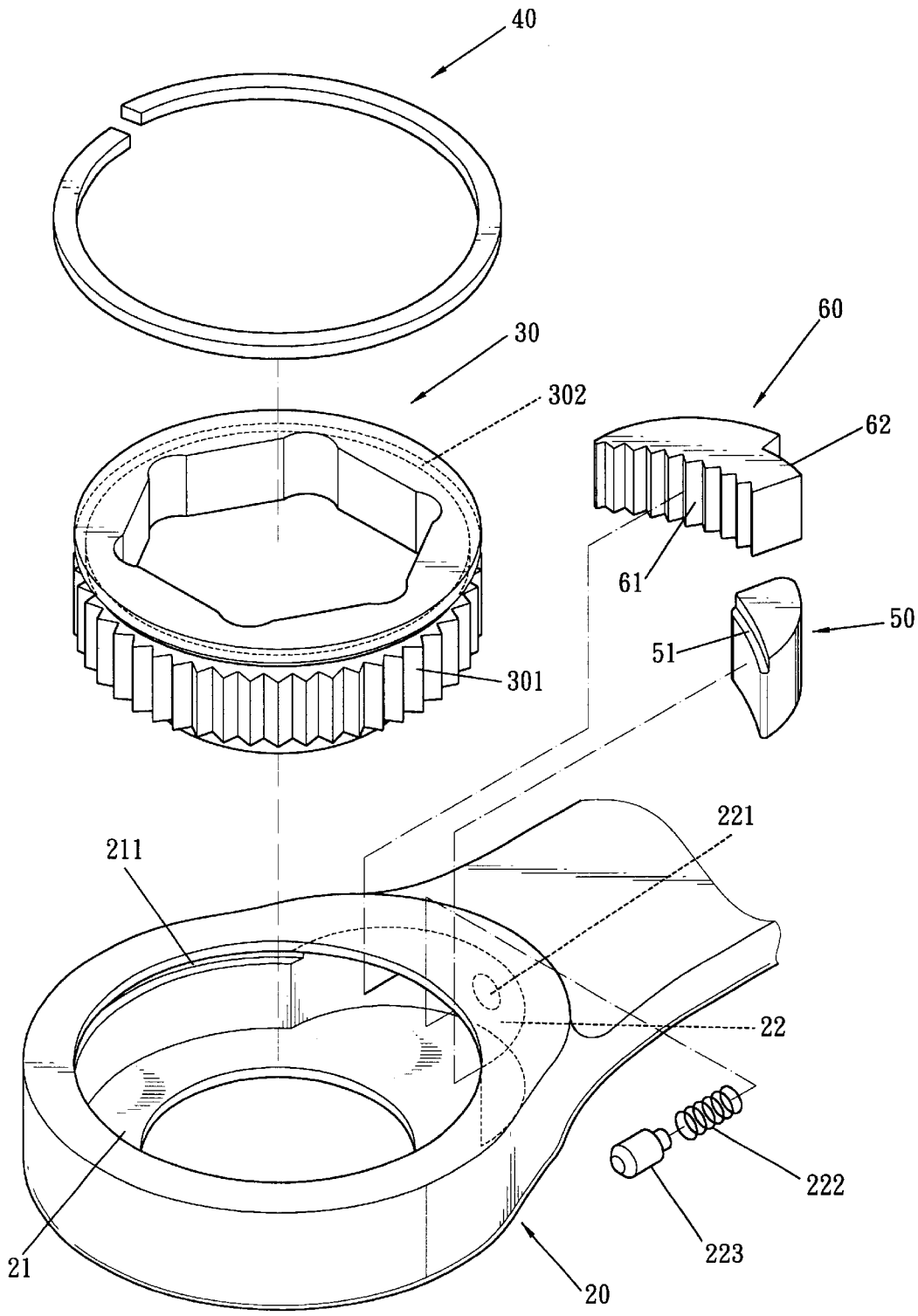
FIG. 3 is an exploded perspective view of a single-directional ratchet wrench structure in accordance with a first embodiment of the present invention.
Figure 4:
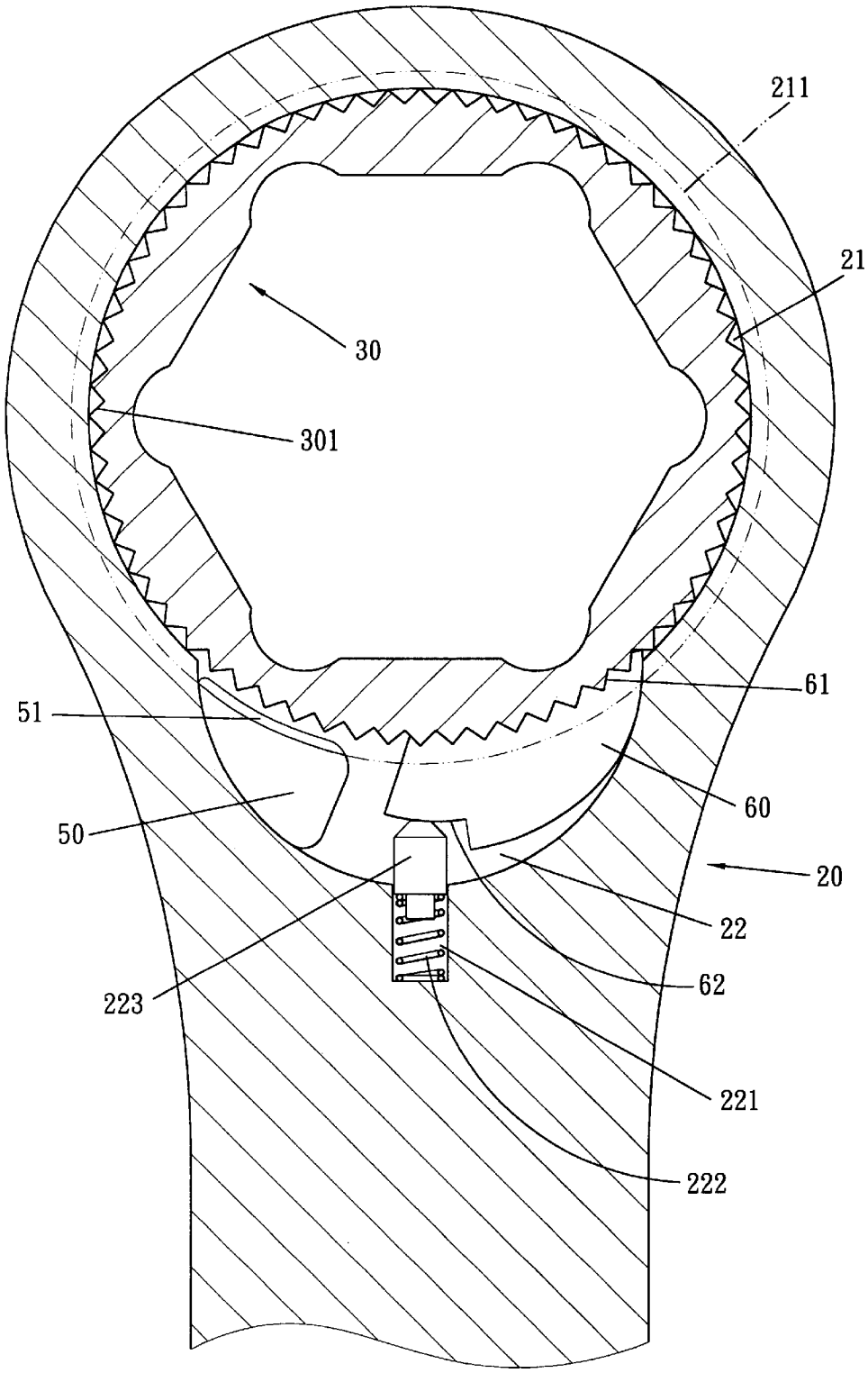
FIG. 4 is a cross-sectional assembly view of the single-directional ratchet wrench structure as shown in FIG. 3.

Referring to the drawings and initially to FIGS. 3 and 4, a single-directional ratchet wrench structure in accordance with a first embodiment of the present invention comprises a wrench 20 having a head formed with a receiving recess 21 for receiving a ratchet wheel 30. The receiving recess 21 has an inner periphery formed with an annular groove 211. The ratchet wheel 30 has an outer periphery formed with ratchet teeth 301 and an annular groove 302. A C-shaped snap ring 40 is snapped in the annular groove 302 of the ratchet wheel 30 and the annular groove 211 of the receiving recess 21, thereby preventing the ratchet wheel 30 from detaching from the receiving recess 21.

One side of the head of the wrench 20 opposite to the ratchet wheel 30 is formed with a receiving space 22 for receiving a mating block 50 and a locking tooth block 60. The locking tooth block 60 is formed with locking teeth 61, and a notch 62. The locking teeth 61 of the locking tooth block 60 engage the ratchet teeth 301 of the ratchet wheel 30.

One side of the receiving space 22 is formed with a receiving cavity 221 for receiving a spring 222 and an urging block 223. The urging block 223 is rested on the notch 62 of the locking tooth block 60 by the elastic force of the spring 222, so that the locking tooth block 60 may drive the ratchet wheel 30 or idle. The urging block 223 may be formed with a first end having an urging face and a second end having a mounting rod. Thus, the urging face may be rested on the notch 62 of the locking tooth block 60, and the spring 222 may be mounted on the mounting rod.

The mating block 50 has an end portion opposite to the ratchet wheel 30 and formed with an insertion groove 51. The C-shaped snap ring 40 may be rested on the insertion groove 51, so that the mating block 50 may be retained in position by the C-shaped snap ring 40.

Figure 5:
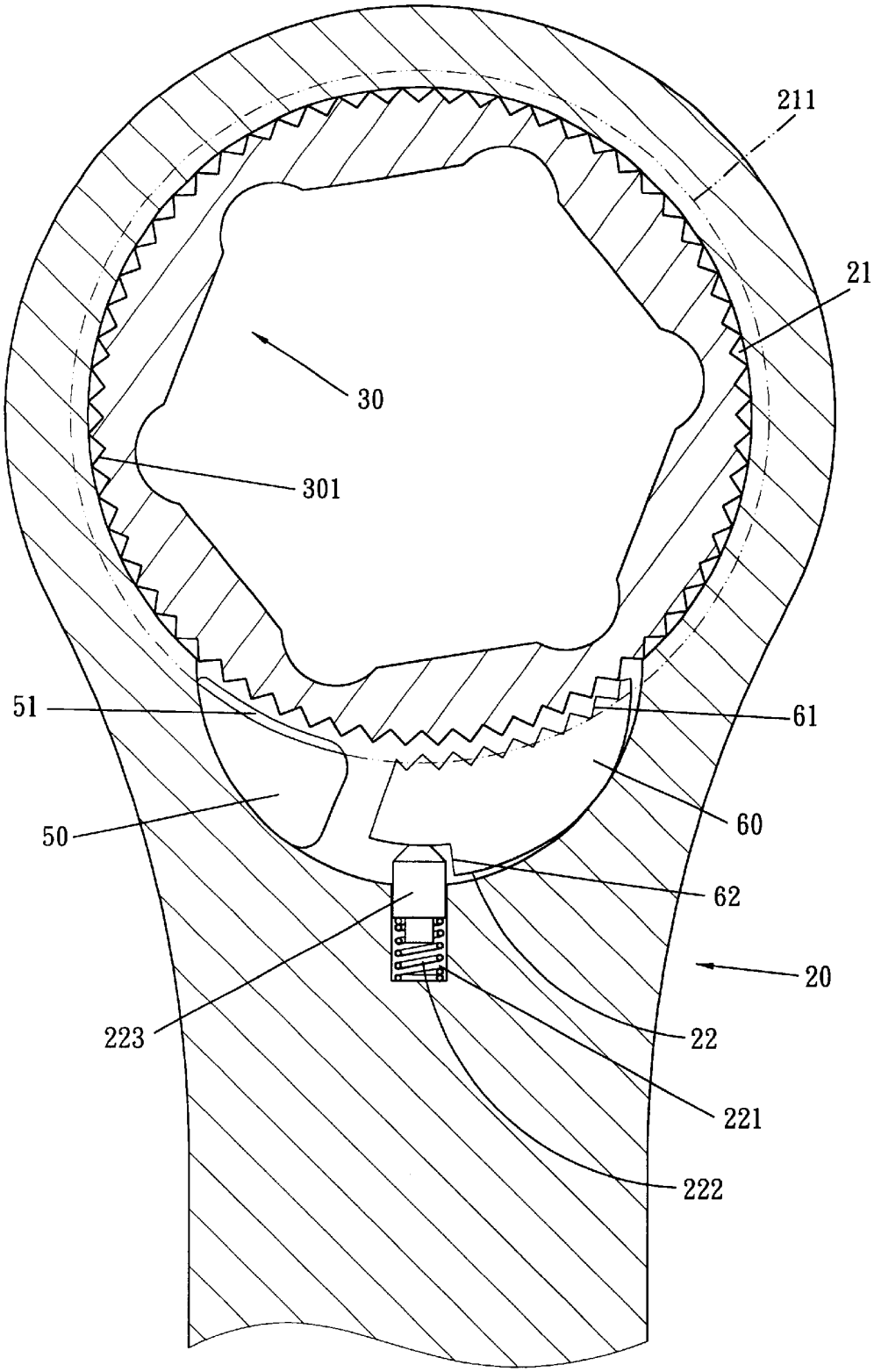
FIG. 5 is a schematic operational view of the single-directional ratchet wrench structure as shown in FIG. 4 in use.

After the mating block 50 is mounted in the receiving space 22, the mating block 50 may be retained in position by the C-shaped snap ring 40. After the mating block 50 is retained in position by the C-shaped snap ring 40, the mating block 50 will not be in contact with the ratchet teeth 301 of the ratchet wheel 30. When the locking tooth block 60 drives the ratchet wheel 30 during operation of the wrench 20, the mating block 50 will not in be contact with the ratchet teeth 301 of the ratchet wheel 30 (see FIG. 5).

Figure 6:
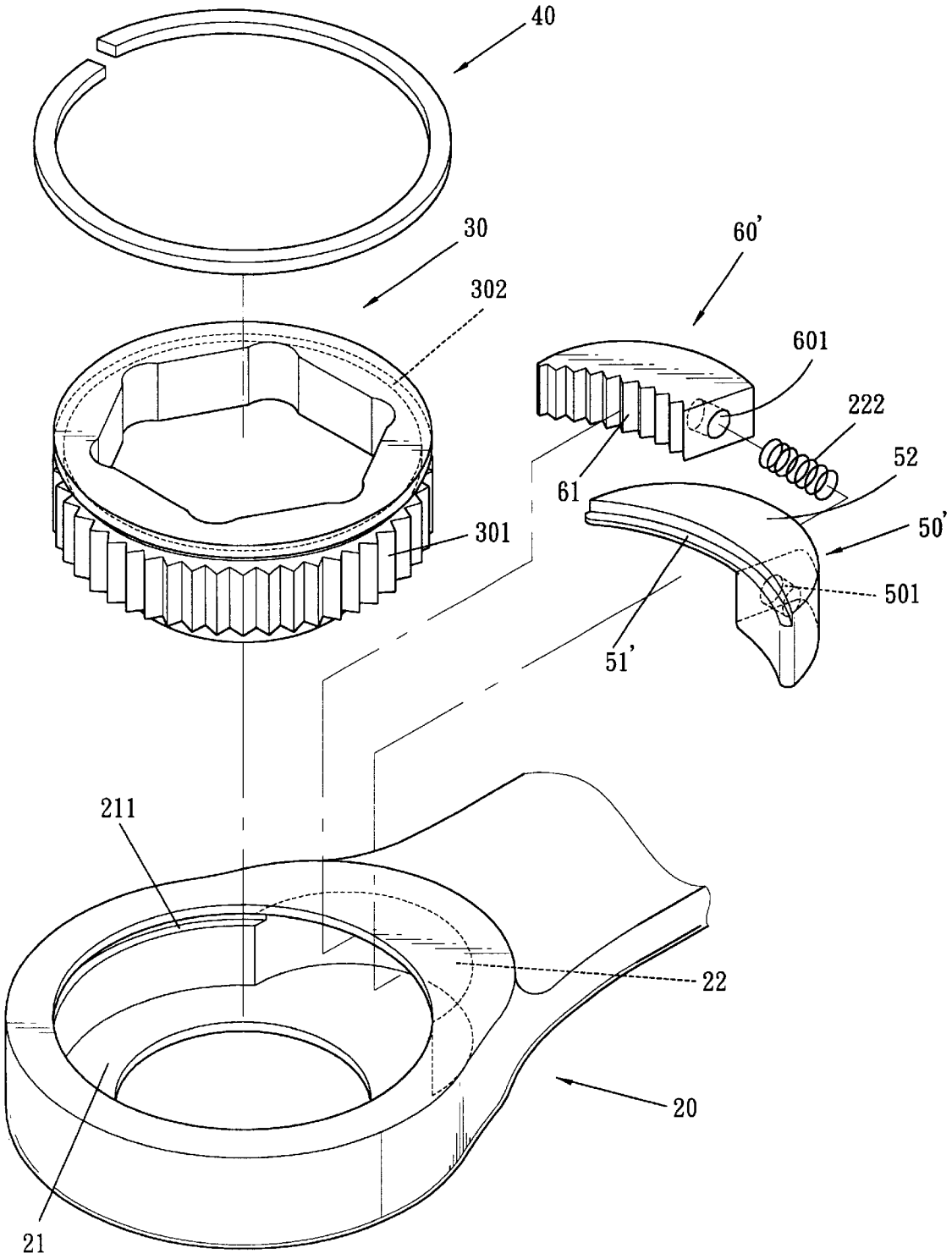
FIG. 6 is an exploded perspective view of a single-directional ratchet wrench structure in accordance with a second embodiment of the present invention.
Figure 7:
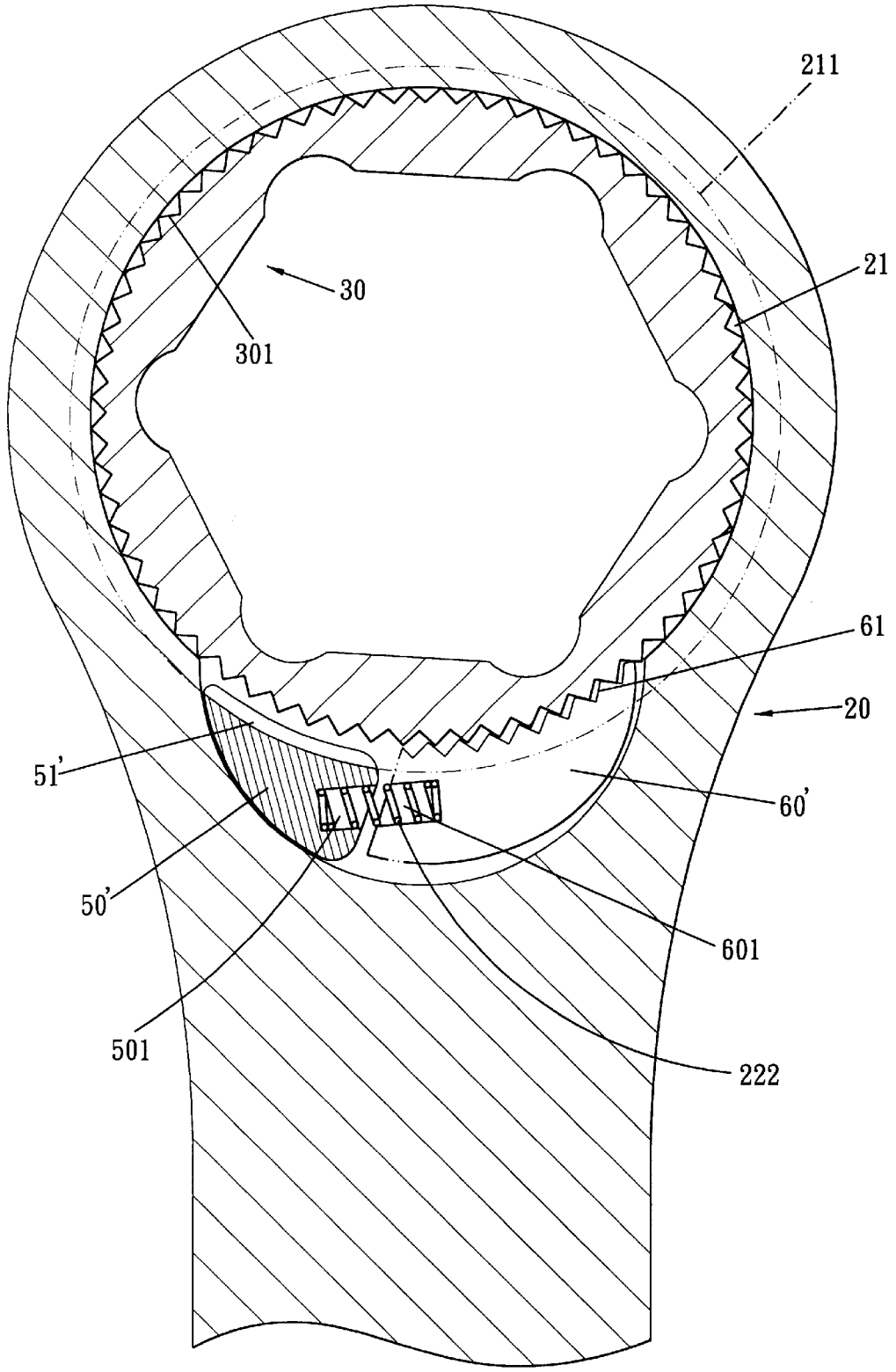
FIG. 7 is a cross-sectional assembly view of the single-directional ratchet wrench structure as shown in FIG. 6.

Referring now to FIGS. 6 and 7, a single-directional ratchet wrench structure in accordance with a second embodiment of the present invention is shown. The mating block 50' has one side formed with a mating recess 501, and the locking tooth block 60' has one side formed with a mating recess 601, so that the spring 222 may be rigidly and stably mounted between the mating recess 501 and the mating recess 601. The mating block 50' has an upper end face formed with an insertion plate 52 extended laterally. The insertion plate 52 has a side edge provided with an insertion groove 51'. The C-shaped snap ring 40 may be rested on the insertion groove 51', so that the mating block 50' may be retained in position by the C-shaped snap ring 40.

The insertion plate 52 laterally extended from the mating block 50' may largely increase the contact area of the mating block 50' and the C-shaped snap ring 40, thereby increasing the structural rigidity.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A single-directional ratchet wrench structure, comprising:

a wrench, having a head formed with a receiving recess for receiving a ratchet wheel, a C-shaped snap ring snapped between the ratchet wheel and the receiving recess, one side of the receiving recess formed with a receiving space for receiving a mating block, a locking tooth block, and a spring, the locking tooth block engaging the ratchet wheel by the spring, the mating block mounted beside the locking tooth block;

wherein, the mating block has an end portion opposite to the ratchet wheel and formed with an insertion groove, so that the C-shaped snap ring may be rested on the insertion groove of the mating block, such that the mating block may be retained in position by the C-shaped snap ring; and the locking tooth block may be formed with locking teeth, and a notch, such that the locking teeth of the locking tooth block may engage ratchet teeth of the ratchet wheel, the receiving space is formed with a receiving cavity for receiving the spring and an urging block, and the urging block is rested on the notch of the locking tooth block by the elastic force of the spring, so that the locking tooth block may engage the ratchet wheel.

2. The single-directional ratchet wrench structure in accordance with claim 1, wherein the urging block may be formed with a first end having an urging face and a second end having a mounting rod, so that the urging face may be rested on the notch of the locking tooth block, and the spring may be mounted on the mounting rod.

3. A single-directional ratchet wrench structure, comprising:

a wrench having a head formed with a receiving recess for receiving a ratchet wheel, a C-shaped snap ring snapped between the ratchet wheel and the receiving recess, one side of the receiving recess formed with a receiving space for receiving a mating block, a locking tooth block, and a spring, the locking tooth block engaging the ratchet wheel by the spring, the mating block mounted beside the locking tooth block;

wherein the mating block has an end portion opposite to the ratchet wheel and formed with an insertion groove, so that the C-shaped snap ring may be rested on the insertion groove of the mating block such that the mating block may be retained in position by the C-shaped snap ring; and wherein the mating block has one side formed with a first mating recess, and the locking tooth block has one side formed with a second mating recess, so that the spring may be rigidly and stably mounted between the first mating recess and the second mating recess, the mating block has an upper end face formed with an insertion plate extended laterally, the insertion plate has a side edge provided with the insertion groove, so that the C-shaped snap ring may be rested on the insertion groove, and so that the mating block may be retained in position by the C-shaped snap ring.

* * * * *